US008037778B2

(12) United States Patent
Kazushi

(10) Patent No.: US 8,037,778 B2
(45) Date of Patent: Oct. 18, 2011

(54) CONTROL LEVER UNIT

(75) Inventor: Kamiya Kazushi, Kariya (JP)

(73) Assignee: Kabushiki Kaisha Toyota Jodoshokki, Aichi-ken (JP)

( * ) Notice: Subject to any disclaimer, the term of this patent is extended or adjusted under 35 U.S.C. 154(b) by 1336 days.

(21) Appl. No.: 11/643,542

(22) Filed: Dec. 20, 2006

(65) Prior Publication Data

US 2008/0264728 A1 Oct. 30, 2008

(30) Foreign Application Priority Data

Dec. 21, 2005 (JP) ..... 2005-368096

(51) Int. Cl.
*G05G 9/047* (2006.01)

(52) U.S. Cl. ..... 74/471 XY

(58) Field of Classification Search ..... 74/471 XY; 200/6 A; 345/161
See application file for complete search history.

(56) References Cited

U.S. PATENT DOCUMENTS

| | | | | |
|---|---|---|---|---|
| 2,985,740 | A * | 5/1961 | Fisher et al. | 200/522 |
| 4,348,556 | A * | 9/1982 | Gettig et al. | 200/6 A |
| 5,804,781 | A | 9/1998 | Okabe | |
| 2003/0170108 | A1* | 9/2003 | Hummer | 414/662 |

FOREIGN PATENT DOCUMENTS

| | | |
|---|---|---|
| EP | 0 301 209 A2 | 2/1989 |
| EP | 0 301 209 A3 | 2/1989 |
| JP | 10-105267 | 4/1998 |
| JP | 2005-174651 | 6/2005 |
| WO | WO 02/088864 | 11/2002 |
| WO | WO 2004/049092 | 6/2004 |

OTHER PUBLICATIONS

European Search Report dated Dec. 21, 2007 issued by European Patent Office for application No. EP 06 12 6505.

* cited by examiner

*Primary Examiner* — Thomas R Hannon
*Assistant Examiner* — Phillip A Johnson
(74) *Attorney, Agent, or Firm* — Locke Lord Bissell & Liddel LLP

(57) ABSTRACT

A control lever unit includes a lever, a sensor, an urging body and an elastically undeformable restricting member. The lever is pivoted tiltably from a neutral position in any direction within 360 degrees including two main operation directions and intermediate directions therebetween. The sensor detects tilt angle of the lever in the two respective main operation directions. The urging body puts the lever back to the neutral position. The restricting member has an interior wall for surrounding the lever to restrict tilting range of the lever. Contour of the interior wall of the restricting member includes main operation stop portions for specifying tilt limit of the lever in the main operation directions and intermediate stop portions for specifying tilt limit of the lever in the intermediate directions. The main operation stop portions are positioned outside a quadrangle with the intermediate stop portions at apexes thereof.

10 Claims, 6 Drawing Sheets

CONTROL LEVER UNIT

BACKGROUND OF THE INVENTION

The present invention relates to a control lever unit for operating equipment provided in a working vehicle.

Japanese Patent Application Publication No. 10-105267 discloses this type of control lever unit, which includes a grip for allowing displacement in at least two main operation directions and intermediate directions between the two main operation directions, a sliding piece, a cam plate with which the sliding piece is brought into contact, and a spring interposed between the grip and the sliding piece for causing a restoring force. The cam plate has a projection at each position with which the sliding piece is brought into contact when the grip (or lever) is displaced in the intermediate direction, thereby to cause larger change of length of the spring when the grip is displaced in the intermediate direction than when the grip is displaced in the main operation direction.

Therefore, it is practically impossible to erroneously operate the grip in the intermediate direction because strong resistance (a restoring force) is applied in operating the grip in the intermediate direction, which enables the lever to be operated accurately in the main operation direction.

It is when the lever is tilted to the maximum in the main operation direction that it is generally the easiest to apply operation force to the grip in this type of control lever unit. When the lever is thus in the maximum tilted position in the main operation direction, it is easy to displace the lever from the main operation direction toward the intermediate direction for some reason, depending on the direction of operation force applied by an operator. Consequently, erroneous operation of the lever frequently occurs to reduce working efficiency.

In this regard, in the control lever unit of Japanese Patent Application Publication No. 10-105267, strong resistance (a restoring force) is applied in operating the grip in the intermediate direction, so that it is regarded that the erroneous operation of the lever toward the side of the intermediate direction is avoided to some extent. In a state where the lever is tilted to the limit in the main operation direction as described above, however, it is frequent that particularly large force is applied to the lever. In this case, there is fear that the erroneous operation of the lever toward the side of the intermediate direction is performed in spite of the above strong resistance.

In the control lever unit of Japanese Patent Application Publication No. 10-105267 where strong resistance is applied in tilting the lever in the intermediate direction, when the lever is used to be actually tilted in the intermediate direction instead of the main operation direction, the lever is heavy in being tilted in the intermediate direction. Therefore, it is easy for an operator to be tired. In this regard, the control lever unit of the cited reference is far from preferable.

The present invention is directed to a control lever unit whose lever hardly causes erroneous operation toward the side of the intermediate direction even in a state that the lever is tilted to the maximum in the main operation direction and whose lever operated in the intermediate direction is not excessively heavy.

SUMMARY OF THE INVENTION

In accordance with a first aspect of the present invention, a control lever unit includes a lever, a sensor, an urging body and an elastically undeformable restricting member. The lever is pivoted tiltably from a neutral position in any direction within 360 degrees including two main operation directions and intermediate directions therebetween. The sensor detects tilt angle of the lever in the two respective main operation directions. The urging body puts the lever back to the neutral position. The restricting member has an interior wall for surrounding the lever to restrict tilting range of the lever. Contour of the interior wall of the restricting member includes main operation stop portions for specifying tilt limit of the lever in the main operation directions and intermediate stop portions for specifying tilt limit of the lever in the intermediate directions. The main operation stop portions are positioned outside a quadrangle with the intermediate stop portions at apexes thereof.

In accordance with a second aspect of the present invention, a working vehicle includes equipment for working and a control lever unit for operating the equipment. The control lever unit includes a lever, a sensor, an urging body and an elastically undeformable restricting member. The lever is pivoted tiltably from a neutral position in any direction within 360 degrees including two main operation directions and intermediate directions therebetween. The sensor detects tilt angle of the lever in the two respective main operation directions. The urging body puts the lever back to the neutral position. The restricting member has an interior wall for surrounding the lever to restrict tilting range of the lever. Contour of the interior wall of the restricting member includes main operation stop portions for specifying tilt limit of the lever in the main operation directions and intermediate stop portions for specifying tilt limit of the lever in the intermediate directions. The main operation stop portions are positioned outside a quadrangle with the intermediate stop portions at apexes thereof.

In accordance with a third aspect of the present invention, a forklift truck includes a fork, a mast and a control lever unit. The fork is used for holding a load. The mast is liftable and tiltable together with the fork. The control lever unit is used for operating the mast. The control lever unit includes a lever, a sensor, an urging body and an elastically undeformable restricting member. The lever is pivoted tiltably from a neutral position in any direction within 360 degrees including two main operation directions and intermediate directions therebetween. The sensor detects tilt angle of the lever in the two respective main operation directions. The urging body puts the lever back to the neutral position. The restricting member has an interior wall for surrounding the lever to restrict tilting range of the lever. Contour of the interior wall of the restricting member includes main operation stop portions for specifying tilt limit of the lever in the main operation directions and intermediate stop portions for specifying tilt limit of the lever in the intermediate directions. The main operation stop portions are positioned outside a quadrangle with the intermediate stop portions at apexes thereof.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
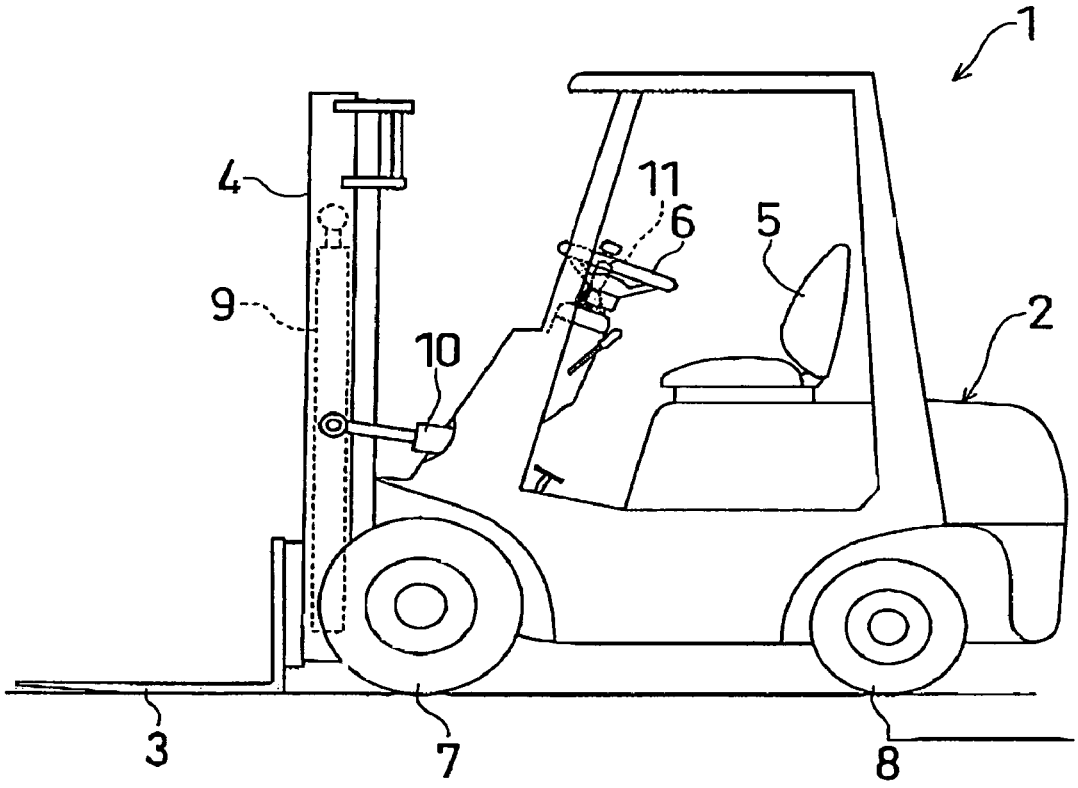
FIG. 1 is a side view of a forklift truck including a control lever unit.

Next will be described embodiments of the present invention. FIG. 1 is a side view of a forklift truck including a control lever unit.

First will be described a forklift truck as a working vehicle including a control lever unit according to a first embodiment with reference to FIG. 1. In the forklift truck 1 shown in FIG. 1, front wheels 7 and rear wheels 8 are suspended from a body 2, and in the front part of the body 2, there are provided a fork 3 for holding a load and a mast 4 liftable and tillable together with the fork 3. A driver seat 5 is provided on the body 2 and operation means such as a steering wheel 6 is provided in the vicinity of the driver seat 5.

The mast 4 includes a lift cylinder (mast lifting means) 9 for lifting the mast 4, and the body 2 includes a tilt cylinder (tilt means) 10 for tilting the mast 4 forward and rearward centering on the axle of the front wheels 7. Also, in the vicinity of the steering wheel 6 in the body 2, there is provided a control lever unit 11 to be operated to direct the lifting/lowering and tilting of the mast 4.

Figure 2:
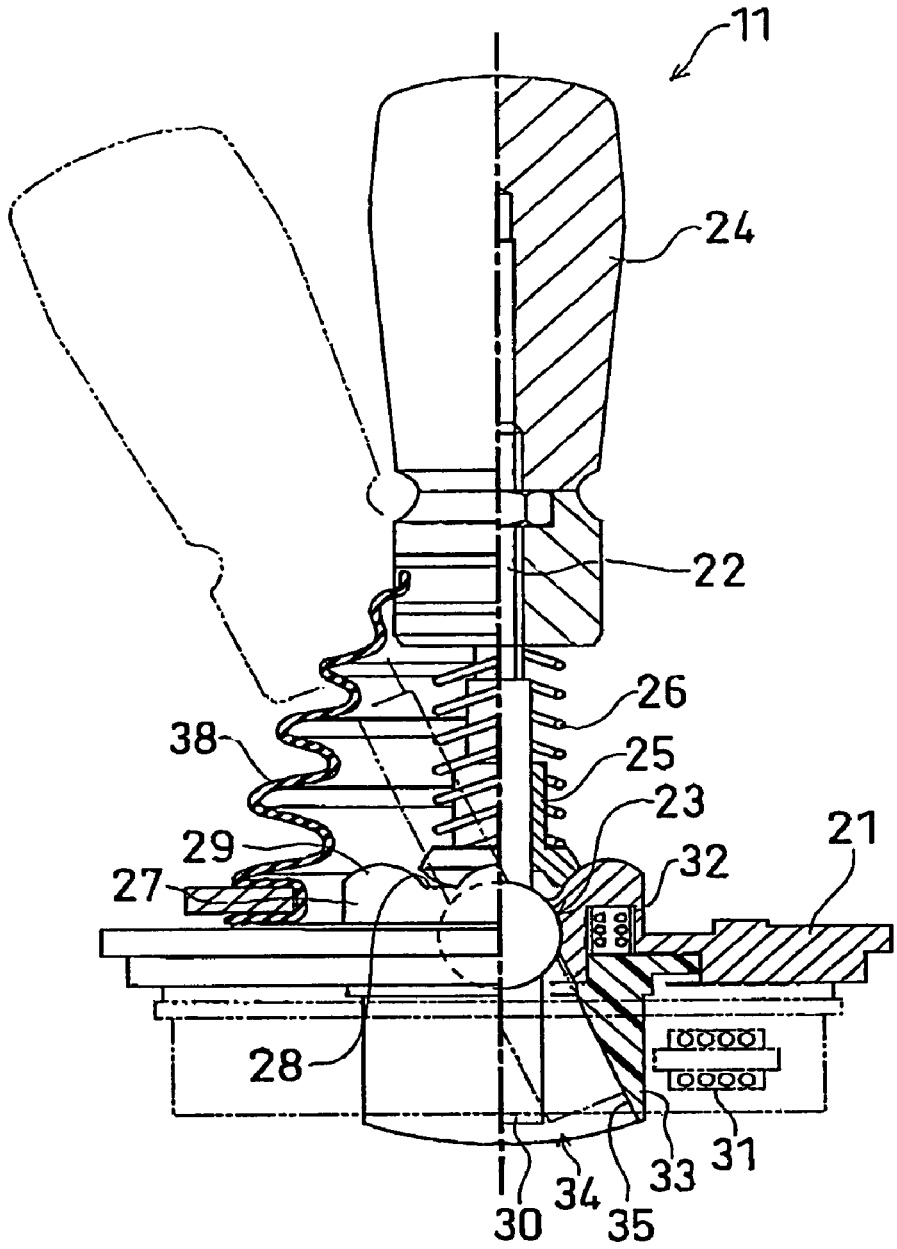
FIG. 2 is a partial cross-sectional view showing the overall configuration of a control lever unit according to a first embodiment of the present invention.
Figure 3:
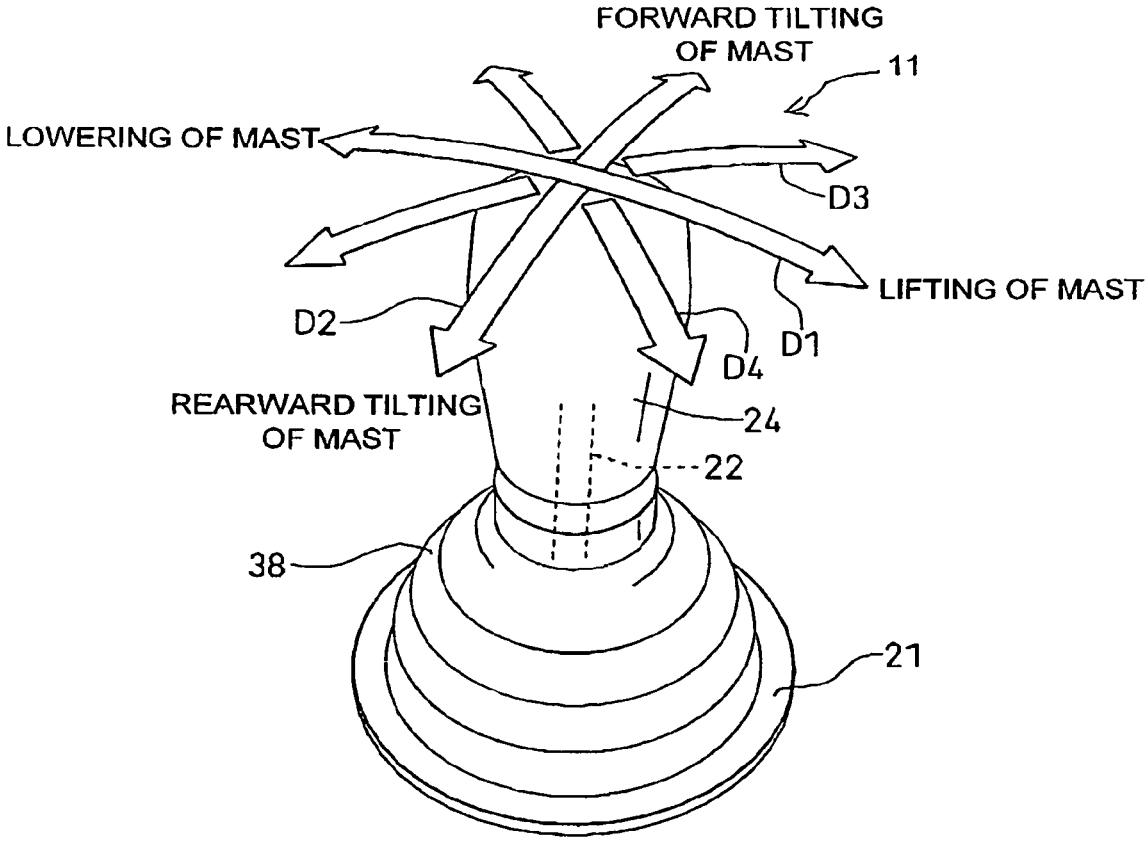
FIG. 3 is a perspective view of the control lever unit when viewed from a driver seat side.
Figure 4:
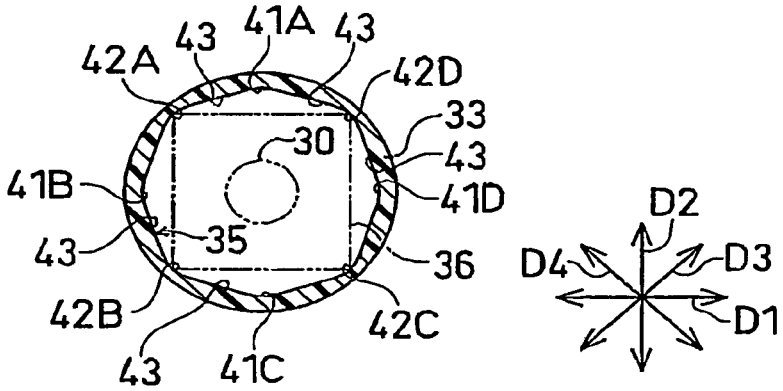
FIG. 4 is a cross-sectional view of a substantial part illustrating the interior wall contour of a restricting member of the control lever unit.
Figure 5:
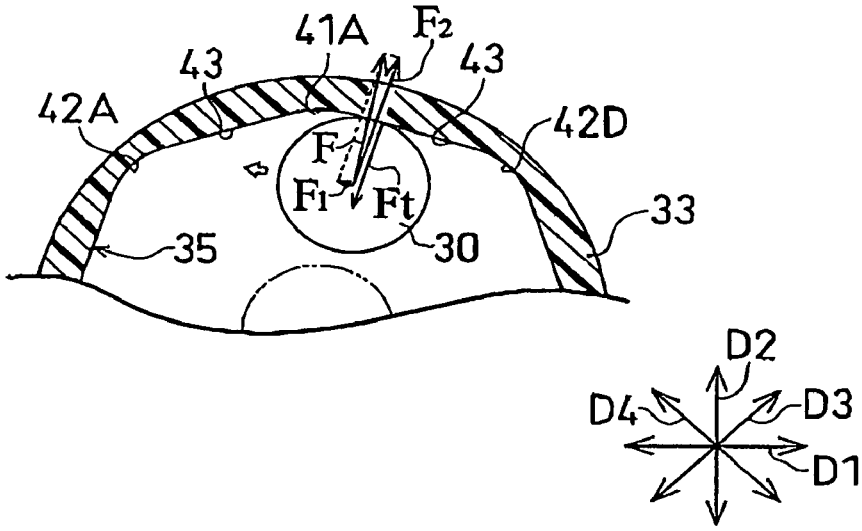
FIG. 5 is a cross-sectional view of a substantial part showing a situation where an extension portion of the lever is held at the maximum tilted position of the lever in a main operation direction regardless of displacement of an operation force at the maximum tilted position.

Next will be described the detailed configuration of the control lever unit 11. FIG. 2 is a partial cross-sectional view showing the overall configuration of a control lever unit according to a first embodiment of the present invention; FIG. 3 is a perspective view of the control lever unit when viewed from the driver seat side; FIG. 4 is a cross-sectional view of a substantial part illustrating the interior wall contour of a restricting member; and FIG. 5 is a cross-sectional view of a substantial part showing a situation where an extension portion of a lever is held at the maximum tilted position of the lever in a main operation direction regardless of displacement of an operation force at the maximum tilted position.

The control lever unit 11 according to the first embodiment shown in FIG. 2 includes a base plate 21 fixed to the body 2. The control lever unit 11 includes an elongated rod-shaped lever 22 and the lever 22 is pivoted on the base plate 21 via a spherical bearing 23. On the upper end side (free end side) of the lever 22, there is fixed a grip 24 on which an operator of the forklift truck 1 will lay his/her hand to apply art operation force. Between the grip 24 and the base plate 21, there is installed a flexible accordion cover 38 for dust prevention, etc.

Since the lever 22 is pivoted via the spherical bearing 23 as mentioned above, the grip 24 (lever 22) can be tilted in any direction within 360 degrees including two main operation directions D1 and D2 perpendicular to each other and intermediate directions D3 and D4 bisecting the angles between the main operation directions D1 and D2, as shown in FIG. 3.

Then, in the present embodiment, the mast 4 can be lifted/lowered by tilting the lever 22 (grip 24) in the first main operation direction D1 (rightward/leftward when viewed from the driver seat 5), while the mast 4 can be tilted forward/rearward by tilting the lever 22 in the second main operation direction D2 (toward the far/near side when viewed from the driver seat 5). Also, the rate of the lifting/lowering and forward/rearward tilting of the mast 4 is increased as the tilt angle of the lever 22 is increased.

Further, the foregoing operations can be performed in a mixed manner when the lever 22 is lilted in a direction between the two main operation directions D1 and D2 (e.g. in the intermediate direction D3 or D4). For example, when the lever 22 is tilted toward the far right side when viewed from the driver seats, the mast is lifted and tilted forward simultaneously. Therefore, operators can wholly operate both the lifting/lowering and tilting with one hand and the layout of the operation means in the forklift truck 1 can be simplified compared to an arrangement including a mast lifting lever and a tilt lever separately.

As shown in FIG. 2, a tubular slider 25 is fitted around the lever 22 slidably in the axial direction, and between the slider 25 and the grip 24, there is arranged a coil spring 26 as an urging body in a state compressed in the axial direction. This causes the slider 25 to be applied constantly with an urging force in a direction away from the grip 24.

An annular cam plate 27 is provided around the base of the lever 22 in such a manner as to face the lower surface of the slider 25. The upper surface of the cam plate 27 is formed with a cam surface 28, the cam surface 28 having four projections 29 in positions that correspond to the end portions in the intermediate directions D3 and D4 (positions keeping out of the main operation directions D1 and D2) centering on the lever 22.

In the arrangement above, when the lever 22 is in the neutral position (upright position), the lower surface of the slider 25 is in contact with the cam surface 28 in a parallel-facing manner and the elastic force of the coil spring 26 is received by the cam surface 28 through the slider 25. From this state, when the lever 22 is tilted from the neutral position in any direction by applying an operation force to the grip 24, the lower surface of the slider 25, the axis of which is tilted together with the lever 22, is brought into disproportionate contact with the cam surface 28, whereby the slider 25 is displaced in a direction closer to the grip 24 to compress the coil spring 26. The compression stroke of the coil spring 26 is increased as the tilt angle of the lever 22 is increased. Therefore, when the operation force to the lever 22 is released with the lever 22 being tilted, the restoring force of the coil spring 26 presses the slider 25 downward, which releases the tilting of the lever 22 for restoration to the neutral position.

It is noted that when the lever 22 is tilted in a direction other than the main operation directions D1 and D2, the lower surface of the slider 25 gets on one of the projections 29, whereby the compression amount, of the coil spring 26 is further increased relative to the case of tilting the lever 22 in the main operation direction D1 or D2. Therefore, if the lever 22 is tilted in, for example, the intermediate direction D3 or D4, the coil spring 26 results in providing a larger restoring force than in the case where tilted in the main operation direction D1 or D2. This means that operators have an operational feeling that the lever 22 is easy to be tilted in the main operation direction D1 or D2, while is slightly hard to be tilted in a direction other than those. Therefore, if operators want to tilt the lever 22 accurately in the main operation direction D1 or D2 (i.e. want to operate only one of either the lifting/lowering or tilting of the mast 4), the lever 22 can be tilted easily in an intended direction using feeling through his/her hand.

The lever 22 has a rod-shaped extension portion 30 formed integrally therewith in an extending manner downward from the pivoting point by the spherical bearing 23. Then, the control lever unit 11 includes measuring coils (sensor) 31 and 32 capable of detecting the position of the extension portion 30 contactlessly, whereby the tilt angle of the lever 22 can be detected by the measuring coils 31 and 32. The measuring coils 31 and 32 can detect decomposed components of the tilting of the lever 22 in the two respective main operation directions D1 and D2. The detection signal enters a controller (not shown in the figures) provided in the forklift truck 1, and then the controller supplies and drains pressure oil to/from the lift cylinder 9 and the tilt cylinder 10 based on the detection signal to lift/lower and tilt the mast 4.

Then, in the control lever unit 11 according to the present embodiment, an elastically undeformable synthetic resin restricting member 33 is provided and fixed to the lower surface of the base plate 21 as shown in FIG. 2. The restricting member 33 has a hollow shape and the internal space 34 thereof has an octagonal pyramid shape widened downward with the tilting center of the lever 22 at the apex of the pyramid. Then, the extension portion 30 of the lever 22 is inserted into the internal space 34 through the apex of the octagonal pyramid. Consequently, the restricting member 33 is arranged in such a manner that an interior wall 35 thereof surrounds the outer periphery of the extension portion 30.

FIG. 4 is a cross-sectional view showing the detailed contour shape of the interior wall 35. As shown in FIG. 4, the cross-sectional contour of the interior wall 35 (when cut along a plane perpendicular to the axis of the lever 22 in the neutral position) has an octagonal shape corresponding to the octagonal pyramid, and four main operation stop portions 41A to 41D and four intermediate stop portions 42A to 42D are provided alternately at the apexes of the octagon.

The main operation stop portions 41A to 41D are adapted to specify the maximum tilted position (tilt limit) of the lever 22 when tilted in the main operation direction D1 or D2. That is, when the lever 22 is tilted in the main operation direction D1 or D2 by a predetermined angle, the extension portion 30 of the lever 22 is brought into contact with one of the main operation stop portions 41A to 41D on the interior wall of the restricting member 33, which can prevent the tilt angle of the lever 22 from being further increased. Similarly, the intermediate stop portions 42A to 42D are adapted to specify the tilt limit of the lever 22 when tilted in the intermediate direction D3 or D4, and when the lever 22 is tilted to the tilt limit, the extension portion 30 is brought into contact with one of the intermediate stop portions 42A to 42D, so that the lever 22 is restricted not to be further tilted.

Then, considering virtually a quadrangle 36 with the intermediate stop portions 42A to 42D at the apexes thereof with respect to the contour of the interior wall 35 shown in FIG. 4, the main operation stop portions 41A to 41D are all positioned outside the quadrangle 36. Also, focusing on one main operation stop portion 41A among the four portions for example, the main operation stop portion 41A and the intermediate stop portions 42A and 42D on both adjacent sides are connected via a straight contour formed by a straight wall 43. Similarly, as for the other main operation stop portions 41B to 41D, each main operation stop portion and corresponding intermediate stop portions on both adjacent sides are connected via a straight contour formed by the straight wall 43.

In the arrangement above, here will be considered a situation where although an operator has tilted the lever 22 to the maximum angle in the second main operation direction D2, the direction of the applied operation force is slightly displaced from the main operation direction D2 for some reason, and the extension portion 30 of the lever 22 is ready to get out of the main operation stop portion 41A as shown in FIG. 5. In this case, the extension portion 30 of the lever 22 is brought into contact with the interior wall having a straight contour (straight wall 43) in the vicinity of the main operation stop portion 41A as shown in FIG. 5. Then, the operation force F applied to the extension portion 30 (slightly displaced from the main operation direction D2) can be decomposed into components $F_1$ and $F_2$, respectively, parallel and perpendicular to the straight wall 43 (it is noted that the component $F_2$ perpendicular to the straight wall 43 is balanced with the reaction force $F_t$ from the straight wall 43). Consequently, the extension portion 30 is moved along the straight wall 43 (as indicated by the outline arrow) by the decomposed part $F_1$ of the operation force F that is parallel to the straight wall 43, and then is guided to be finally put back to the main operation stop portion 41A. This means that when the lever 22 is in the maximum tilted position in the second main operation direction D2, the lever 22 cannot be moved easily from the maximum tilted position toward the first main operation direction D1 even if the direction of the operation force F applied to the lever 22 is slightly displaced from the second main operation direction D2 for some reason.

It is noted that when the lever 22 is tilted to the maximum tilted position in the main operation direction D1 or D2 (e.g. D2) as mentioned above, it is easy for operators to apply a large operation force to the lever 22. Therefore, in this state, it is often the case that a large operation force F is applied to the lever 22 with a directional displacement. On this point, in the present embodiment, the guiding force $F_1$, which has a direction in which the lever 22 is put back to the main operation stop portion 41A, is a decomposed part of the operation force F applied by the operator, whereby even if the operation force F to the lever 22 is strong as mentioned above, the position of the extension portion 30 (lever 22) can be moved along the straight wall 43 by an accordingly large guiding force $F_1$. Therefore, even if the direction of the operation force F is slightly displaced from the main operation direction D2 and the operation force F is strong, it is possible to hold the lever 22 reliably so that the lever 22 is not displaced from the maximum angle position in the main operation direction D2 (corresponding to the position of the main operation stop portion 41A) toward the other main operation direction D1.

As described heretofore, the control lever unit 11 according to the present embodiment has: lever 22 pivoted tiltably from the neutral position in any direction within 360 degrees including the two main operation directions D1 and D2 and the intermediate directions D3 and D4 therebetween; measuring coils 31 and 32 for detecting the tilt angle of the lever 22 in the two respective main operation directions D1 and D2; and coil spring 26 for putting the lever 22 back to the neutral position. The control lever unit 11 further includes the restricting member 33, and the interior wall 35 of the restricting member 33 surrounds the periphery of the lever 22 to restrict the tilting range of the lever 22. Then, the contour of the interior wall 35 of the restricting member 33 includes the main operation stop portions 41A to 41D for specifying the tilt limit of the lever 22 in the main operation directions D1 and D2 and the intermediate stop portions 42A to 42D for specifying the tilt limit of the lever 22 in the intermediate directions D3 and D4. The main operation stop portions 41A to 41D are positioned outside a quadrangle with the intermediate stop portions 42A to 42D at the apexes thereof.

In the arrangement above, when the lever 22 is tilted to the tilt limit in the main operation direction D2 so that the extension portion 30 is in contact with, for example, the main operation stop portion 41A, the lever 22 can be held by the interior wall 35 of the restricting member 33 not to be moved from the main operation stop portion 41A toward the intermediate stop portion 42A or 42D as long as the operation force F applied to the lever 22 in this state faces approximately the main operation direction D2 even if the operation force F does not face the main operation direction D2 exactly and is slightly displaced. It is consequently possible to prevent the lever 22 from being operated erroneously (especially erroneous operations when the lever 22 is in the maximum tilted position in the main operation direction D2).

In addition, the force $F_1$ for preventing such erroneous operations is obtained by utilizing the operation force F of the operator, whereby even if the operator applies a large operation force F in a direction displaced from the main operation direction D2, an accordingly large guiding force $F_1$ can reliably prevent the lever 22 from being operated erroneously. It will be appreciated that erroneous operations can be avoided in the same way even if the lever 22 is tilted to the tilt limit in the other main operation direction D1.

Also, in the control lever unit 11 according to the present embodiment, straight portions formed by the straight wall 43 are arranged between each main operation stop portion (e.g. 41A) and corresponding intermediate stop portions (e.g. 42A and 42D) on both adjacent sides on the contour of the interior wall 35 of the restricting member 33.

Therefore, even if the extension portion 30 tries to get out of a main operation stop portion (e.g. 41A) due to a directional displacement of the operation force F, the extension portion 30 can be put back to the main operation stop portion 41A smoothly by being guided by the straight wall 43. Also, in the case of operating the lever 22 from the maximum tilted position in the main operation direction D2 to the maximum tilted position in an intermediate direction (e.g. D3), the straight wall 43 between the main operation stop portion 41A and the intermediate stop portion 42D causes the extension portion 30 to be slid and guided, whereby operators can perform the operation with a smooth operational feeling.

Also, in the present embodiment, the rod-shaped extension portion 30 of the lever 22 can be in contact with the interior wall 35 of the restricting member 33. Then, the interior wall 35 forms the internal space 34 having an octagonal pyramid shape.

Therefore, the shape of the restricting member 33 can be simplified and the contact area between the interior wall 35 and the extension portion 30 can be widened in the longitudinal direction of the extension portion 30, which can suppress the abrasion of the interior wall 35 and the extension portion 30 to reduce the frequency of need for maintenance.

In addition, since the forklift truck 1 shown in FIG. 1 includes the thus arranged control lever unit 11, it is possible to simplify the operation means as well as to prevent erroneous operations of equipment.

Further, in the forklift truck, the mast 4 is lifted/lowered by tilting the lever 22 in the first main operation direction D1, while the mast 4 is tilted by tilting the lever 22 in the second main operation direction D2. Therefore, if it is required to operate only one of either the lifting/lowering or tilting of the mast 4 (such a situation occurs frequently in cargo handling operations), it is possible to prevent the other operation from being performed simultaneously due to an erroneous operation of the control lever unit 11. Since it is consequently possible to achieve operator's intended operations exactly, the cargo handling operations can be performed efficiently.

Figure 6:
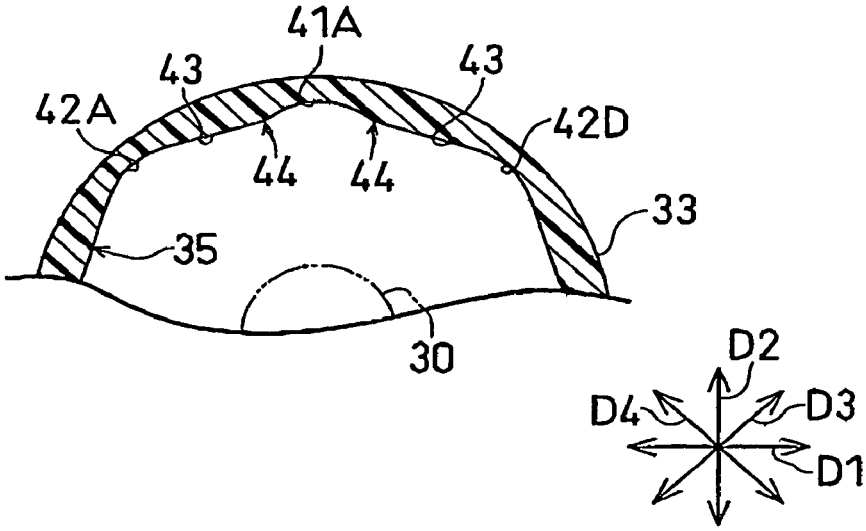
FIG. 6 is a cross-sectional view of a substantial part illustrating an example in which projecting portions are formed in the interior wall of the restricting member.

It is noted that the contour of the interior wall 35 of the restricting member 33 may also be formed as shown in FIG. 6. In the arrangement shown in FIG. 6, the interior wall 35 is formed in such a manner that the main operation stop portion 41A is slightly recessed and relatively projecting portions 44 are formed on immediate either side of the recessed main operation stop portion 41A. It is noted that although only one of the four main operation stop portions 41A to 41D is shown in FIG. 6, the other main operation stop portions 41B to 41D are also recessed. However, the intermediate stop portions 42A to 42D are not recessed and the positions where the projecting portions 44 are formed on the interior wall 35 are only in the vicinity of the main operation stop portions 41A to 41D.

In the arrangement above, here is assumed that an operator tilts the lever 22 to the maximum tilted position in the second main operation direction D2 and the extension portion 30 gets in the recessed main operation stop portion 41A. Here, since it is easy for operators to apply a large operation force to the lever 22 when the lever 22 is tilted to the tilt limit as mentioned above, it is assumed that the direction of the operation force F is slightly displaced toward the first main operation direction D1 for some reason. However, in the arrangement shown in FIG. 6, since the projecting portions 44 prevent the lever 22 from getting out of the main operation stop portion 41A, it is possible to prevent erroneous operations more reliably.

Figure 7:
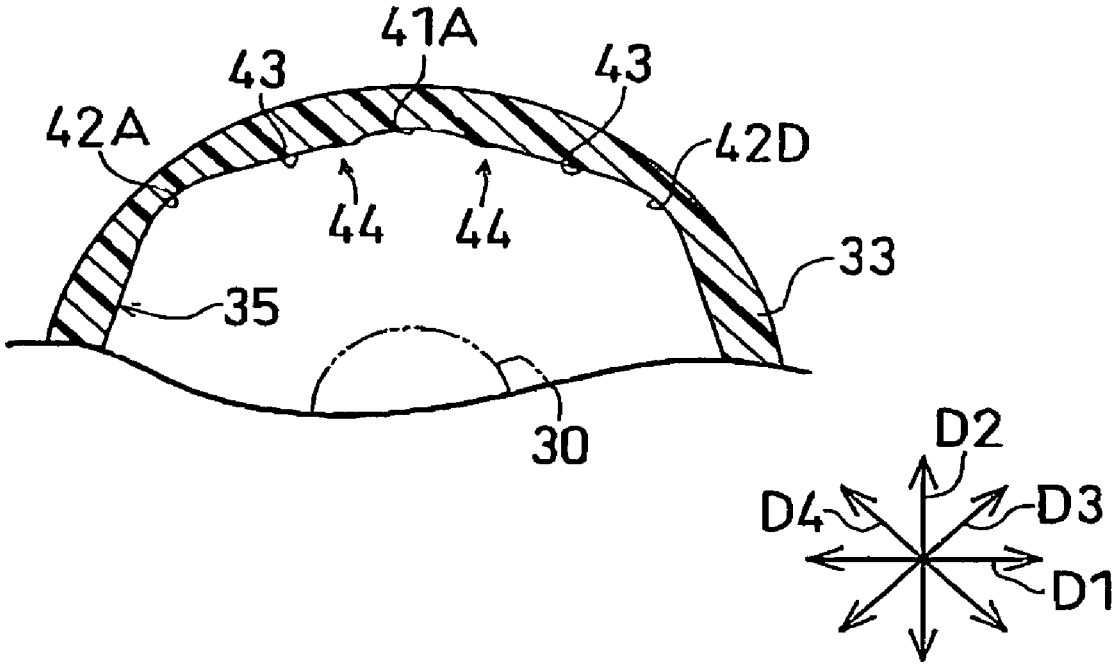
FIG. 7 is a cross-sectional view of a substantial part illustrating another example in which projecting portions are formed in the interior wall of the restricting member.

Also, as shown in FIG. 7, the contour of the interior wall 35 may be arranged in such a manner that the main operation stop portion 41A is not recessed and projecting portions 44 are simply formed on either side of the main operation stop portion 41A.

As described heretofore, on the interior wall 35 of the restricting member 33 shown in the examples of FIGS. 6 and 7, the projecting portions 44 are provided in the vicinity of the main operation stop portions 41A to 41D. Therefore, even if the operation force F applied to the lever 22 is slightly displaced from the main operation direction D2 when the lever 22 is in the tilt limit position in the main operation direction D2, the lever 22 is held in the tilt limit position reliably by the projecting portions 44. Consequently, erroneous operations can be avoided more reliably.

Further, in the example of FIG. 6, the main operation stop portions 41A to 41D are each formed in a recessed shape and the projecting portions 44 are formed as relatively projecting portions on either side of each recessed portion. This allows the lever 22 to be held in the tilt limit position in one of the main operation directions exactly and reliably by the recessed portions.

Figure 8:
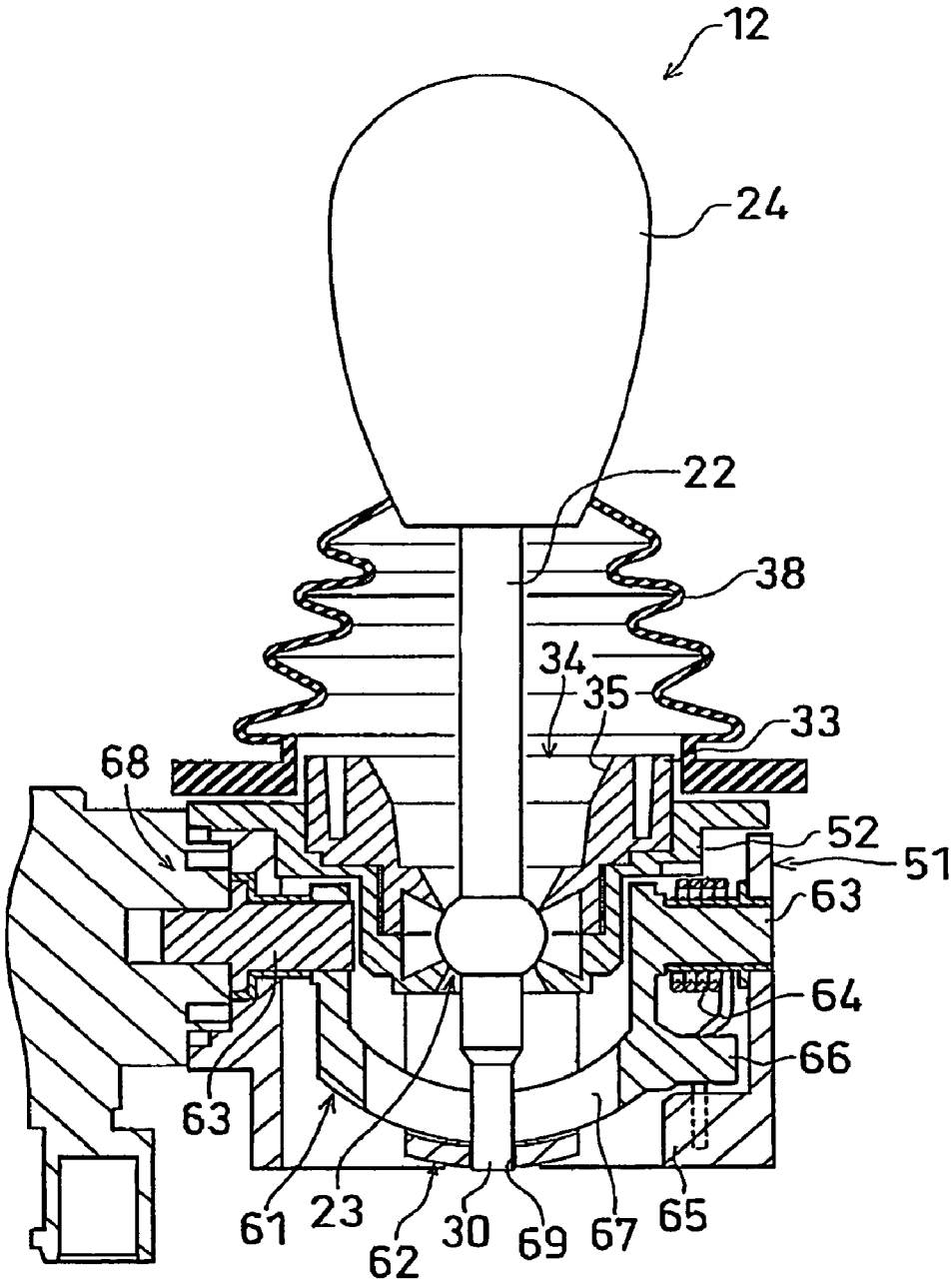
FIG. 8 is a view showing an axial plane of a control lever unit according to a second embodiment of the present invention.

Next will be described the configuration of a control lever unit 12 according to a second embodiment with reference to FIG. 8. It is noted that in the present second embodiment, components identical with or similar to those in the control lever unit 11 according to the first embodiment may be designated by the same reference numerals to omit the description thereof.

The control lever unit 12 includes a hollow housing 51 to be installed in the vicinity of the steering wheel 6 in the forklift truck 1. A bearing support member 52 is fixed to the housing 51 and the restricting member 33 is fixed to the bearing support member 52.

Then, the bearing support member 52 and restricting member 33 support a spherical portion formed on the base end side of the lever 22 in a vertically sandwiching manner, in this part being formed the spherical bearing 23. Consequently, the lever 22 and the grip 24 fixed to the free end side of the lever 22 can be tilted in any direction within 360 degrees, as is the case in the first embodiment.

The housing 51 supports a trunnion-shaped first rocking member 61 so as to freely rock in the first main operation direction D1. Rocking shafts 63 are provided on either end of the first rocking member 61, the axis of the rocking shafts 63 passing through the tilting center of the lever 22. Then, a twisted coil spring-shaped return spring (urging body) 64 is arranged on the outer periphery of one of the rocking shafts 63, and the both ends of the spring line of the return spring 64 are pulled appropriately out of the coil portion to sandwich a projection 65 provided in the housing 51 and a projection 66 provided on the first rocking member 61. In this arrangement, when the first rocking member 61 is tilted in the first main operation direction D1, the projection 66 moves, whereby the spring lines either end of the return spring 64 are pulled by the two projections 65 and 66. Consequently, the return spring 64 is to apply a restoring force to the first rocking member 61 in a direction of restoring the tilting action.

In the first rocking member 61, there is formed an elongated hole 67 along the second main operation direction D2, and the extension portion 30 of the lever 22 is inserted through the elongated hole 67. Also, a potentiometer (sensor) 68 is arranged on the rocking shafts 63 of the first rocking member 61, whereby the tilt direction and angle of the first rocking member 61 can be detected.

Further, the housing 51 supports a trunnion-shaped second rocking member 62 rockably in the second main operation direction D2. The axis of the rocking shafts (not shown in the figure) of the second rocking member 62 passes through the tilting center of the lever 22 and is perpendicular to the axis of the rocking shafts 63 of the first rocking member 61 at the tilting center. In the second rocking member 62, there is formed an elongated hole 69 along the first main operation direction D1, and the extension portion 30 of the lever 22 is inserted through the elongated hole 69.

It is noted that a return spring is arranged also on the second rocking member 62, as is the case with the first rocking member 61, though not shown in the figure. When the second rocking member 62 is tilted, the return spring is to apply a restoring force to the second rocking member 62 in a direction of restoring the tilting action. There is also arranged a potentiometer (not shown in the figure) capable of detecting the tilt direction and angle of the second rocking member 62, as is the case with the potentiometer 68 installed to the first rocking member 61.

The restricting member 33 has a hollow shape and includes an interior wall 35 surrounding the periphery of the base of the lever 22. The internal space 34 of the restricting member 33 has an approximately octagonal pyramid shape widened upward with the tilting center of the lever 22 at the apex of the pyramid.

Unlike the first embodiment in which the extension portion 30 under the lever 22 is restricted by the interior wall 35, in the present embodiment the upper base of the lever 22 (closer to the grip 24 than the pivoting point by the spherical bearing 23) is restricted and guided by the interior wall 35, where the substantial function of the interior wall 35 of the restricting member 33 is the same as in the first embodiment. As a cross-sectional contour of the interior wall 35, the shapes described in, for example, the first embodiment (shown in FIGS. 4, 6, and 7) can be employed without modification.

In the arrangement above, when an operator lays his/her hand on the grip 24 to tilt the lever 22 from the neutral position in any direction, the component of the tilting action in the first main operation direction D1 is detected by the potentiometer 68 as the tilt amount of the first rocking member 61, while the component in the second main operation direction D2 is detected by the potentiometer not shown in the figure as the tilt amount of the second rocking member 62. Then, when the operation force to the grip 24 is released from this state, the lever 22 is put back to the neutral position by the return spring 64 that is installed to the first rocking member 61 and the return spring not shown in the figure that is installed to the second rocking member 62.

Then, the restricting member 33 exhibits substantially the same guiding effect as described heretofore in the first embodiment with reference to FIG. 5, which makes it possible to prevent erroneous operations when the lever 22 is tilted to the maximum tilted position in the main operation direction D1 or D2.

Although multiple embodiments and exemplary variations of the present invention have heretofore been described, the foregoing arrangements are merely examples and can be modified, for example, as follows.

Although the main operation directions D1 and D2 are set at right angles to each other in the foregoing arrangements, the setting may be modified so that the two main operation directions D1 and D2 intersect with each other at an angle other than 90 degrees. Also, the intermediate directions D3 and D4 may be set in directions other than those bisecting the angles between the two main operation directions D1 and D2.

The projections 29 may be omitted in the arrangement of the first embodiment (FIG. 2). Even in this case, it is possible to avoid erroneous operations of the lever 22 when tilted to the maximum tilted position in the main operation direction D1 or D2 by forming the contour of the interior wall 35 of the restricting member 33 as shown in FIG. 4, for example.

As a sensor for detecting the tilt angle of the lever 22, there may be used, for example, a rotary encoder without limitation to the measuring coils 31 and 32 in the first embodiment or the potentiometer 68 in the second embodiment. Also, as an urging body for putting the lever 22 back to the neutral position, there may be used another elastic body without limitation to the coil spring 26 or the return spring 64.

The internal space 34 of the restricting member 33 may be formed in an octagonal pyramid trapezoidal shape instead of forming in an octagonal pyramid shape.

Instead of restricting the extension portion 30 as a part of the lever 22 by the restricting member 33, it may be arranged that a rod-shaped member is, for example, fixed to the lever 22 so that the rod-shaped member (not included in the lever 22) is tilted integrally with the lever 22, and that the rod-shaped member is restricted by being brought into contact with the interior wall 35 of the restricting member 33.

The restricting member 33 may be modified into a plate shape. In this case, it is only required that the inside of the member is punched into an octagonal shape, and that the extension portion 30 of the lever 22, etc. can be in contact with the interior wall formed.

In the configuration shown in FIG. 2 for example, it may be arranged that a circular plate is attached to the lower end of the extension portion 30 so as to freely roll on the lower end of the extension portion 30, and that the rim of the circular plate is in rolling contact with the interior wall 35 of the restricting member 33.

Without limitation to assigning the lifting/lowering and tilting of the mast to the main operation directions D1 and D2, operations for other various equipments may be assigned.

Also, the above-described control lever units 11 and 12 are applicable as ones for operating working vehicles other than forklift trucks (e.g. high-place working vehicles) or other machines.

Therefore, the present examples and embodiments are to be considered as illustrative and not restrictive, and the invention is not to be limited to the details given herein but may be modified within the scope of the appended

What is claimed is:

1. A control lever unit comprising:

a lever pivoted tiltably from a neutral position in any direction within 360 degrees including two main operation directions and intermediate directions therebetween, wherein the first main operation direction is associatable with a first operational task and the second main operation direction is associatable with a second operational task;

a sensor for detecting decomposed components of a tilting angle of the lever in the two main operation directions so that the first operational task and second operational task can be performed simultaneously;

an urging body for putting the lever back to the neutral position; and an elastically undeformable restricting member having an interior wall for surrounding the lever to restrict tilting range of the lever, contour of the interior wall of the restricting member including main operation stop portions for specifying tilt limit of the lever in the main operation directions and intermediate stop portions for specifying tilt limit of the lever in the intermediate directions, wherein the main operation stop portions are positioned outside a quadrangle with the intermediate stop portions at apexes thereof, wherein straight portions are arranged between each main operation stop portion and corresponding intermediate stop portions on both adjacent sides on the contour of the interior wall of the restricting member, and each straight portion extends from a main operation stop portion to an intermediate stop portion and is not parallel or orthogonal to the sides of the quadrangle.

2. The control lever unit according to claim 1, wherein the interior wall of the restricting member is formed in such a manner that projecting portions are provided in the vicinity of the main operation stop portions.

3. The control lever unit according to claim 2, wherein the interior wall of the restricting member is formed in such a manner that the main operation stop portions are each formed in a recessed shape and the projecting portions are formed as relatively projecting portions on either side of each recessed portion.

4. The control lever unit according to claim 1, wherein the lever is formed so as to be capable of contacting the interior wall of the restricting member, the interior wall forming an internal space having a pyramid shape or a pyramid trapezoidal shape.

5. The control lever unit according to claim 1, wherein a rod-shaped member which is tilted with the lever is formed so as to be capable of contacting the inferior wall of the restricting member, the interior wall forming an internal space having a pyramid shape or a pyramid trapezoidal shape.

6. The control lever unit according to claim 1, wherein the sensor includes a measuring coil or a potentiometer.

7. The control lever unit according to claim 1, wherein the urging body includes a coil spring and a return spring.

8. A working vehicle comprising:

equipment for working;

a control lever unit for operating the equipment comprising:

a lever pivoted tiltably from a neutral position in any direction within 360 degrees including two main operation directions and intermediate directions therebetween, wherein the first main operation direction is associatable with a first operational task and the second main operation direction is associatable with a second operational task;

a sensor for detecting decomposed components of a tilting angle of the lever in the two main operation directions so that the first operational task and second operational task can be performed simultaneously;

an urging body for putting the lever back to the neutral position; and an elastically undeformable restricting member having an interior wall for surrounding the lever to restrict tilting range of the lever, contour of the interior wall of the restricting member including main operation stop portions for specifying tilt limit of the lever in the main operation directions and intermediate stop portions for specifying tilt limit of the lever in the intermediate directions, wherein the main operation stop portions are positioned outside a quadrangle with the intermediate stop portions at apexes thereof, wherein straight portions are arranged between each main operation stop portion and corresponding intermediate stop portions on both adjacent sides on the contour of the interior wall of the restricting member, and each straight portion extends from a main operation stop portion to an intermediate stop portion and is not parallel or orthogonal to the sides of the quadrangle.

9. A forklift truck comprising:

a fork for holding a load;

a mast liftable and tiltable together with the fork;

a control lever unit for operating the mast comprising:

a lever pivoted tiltably from a neutral position in any direction within 360 degrees including two main operation directions and intermediate directions therebetween, wherein the first main operation direction is associatable with a first operational task and the second main operation direction is associatable with a second operational task;

a sensor for detecting directions decomposed components of a tilting angle of the lever in the two main operation directions so that the first operational task and second operational task can be performed simultaneously;

an urging body for putting the lever back to the neutral position; and an elastically undeformable restricting member having an interior wall for surrounding the lever to restrict tilting range of the lever, contour of the interior wall of the restricting member including main operation stop portions for specifying tilt limit of the lever in the main operation directions and intermediate stop portions for specifying tilt limit of the lever in the intermediate directions, wherein the main operation stop portions are positioned outside a quadrangle with the intermediate stop portions at apexes thereof, wherein straight portions are arranged between each main operation stop portion and corresponding intermediate stop portions on both adjacent sides on the contour of the interior wall of the restricting member, and each straight portion extends from a main operation stop portion to an intermediate stop portion and is not parallel or orthogonal to the sides of the quadrangle.

10. The forklift truck according to claim 9, wherein the mast is lifted or lowered by tilting the lever in one of the two main operation directions, while the mast is tilted by tilting the lever in the other of the two main operation directions.

* * * * *